US010752426B2

(12) United States Patent
Myles

(10) Patent No.: US 10,752,426 B2
(45) Date of Patent: Aug. 25, 2020

(54) PROGRAMMABLE ACCESSORY FOR BEVERAGE CONTAINERS

(71) Applicant: Kortney Amelia Myles, Brookhaven, GA (US)

(72) Inventor: Kortney Amelia Myles, Brookhaven, GA (US)

( * ) Notice: Subject to any disclaimer, the term of this patent is extended or adjusted under 35 U.S.C. 154(b) by 0 days.

(21) Appl. No.: 16/252,956

(22) Filed: Jan. 21, 2019

(65) Prior Publication Data

US 2019/0233197 A1 Aug. 1, 2019

Related U.S. Application Data

(60) Provisional application No. 62/780,527, filed on Dec. 17, 2018, provisional application No. 62/590,047, filed on Nov. 22, 2017.

(51) Int. Cl.
*B65D 81/38* (2006.01)
*A47G 19/22* (2006.01)

(52) U.S. Cl.
CPC ..... *B65D 81/3876* (2013.01); *A47G 19/2227* (2013.01); *A47G 19/2288* (2013.01); *A47G 2019/2238* (2013.01)

(58) Field of Classification Search
None
See application file for complete search history.

(56) References Cited

U.S. PATENT DOCUMENTS

| | | | | |
|---|---|---|---|---|
| 7,063,432 | B2 * | 6/2006 | VanderSchuit | A47G 19/2222 362/101 |
| 9,035,222 | B2 * | 5/2015 | Alexander | A47G 19/027 219/432 |
| 10,512,358 | B1 * | 12/2019 | Perrelli | B65D 81/3222 |
| 2009/0206084 | A1 * | 8/2009 | Woolf | B65D 81/3205 220/500 |
| 2015/0335183 | A1 * | 11/2015 | Balachandran | A47G 19/2288 219/438 |

* cited by examiner

*Primary Examiner* — K. Wong
(74) *Attorney, Agent, or Firm* — Ellenoff Grossman & Schole LLP; James M. Smedley; Alex Korona

(57) ABSTRACT

This invention relates generally to beverage-ware in the form of beverage container sleeves and similar such beverage-ware devices for use with beverage containers. More particularly, the present invention relates to an ornamental and multi-functional beverage container accessory for engagement with water bottles, beer bottles, wine bottles, champagne bottles, liquor bottles, alcohol bottles, cups and similar beverage containers.

18 Claims, 5 Drawing Sheets

PROGRAMMABLE ACCESSORY FOR BEVERAGE CONTAINERS

CROSS-REFERENCE TO RELATED APPLICATIONS

This application claims the benefit of U.S. Provisional Application No. 62/590,047, filed Nov. 22, 2017 and U.S. Provisional Application No. 62/780,527, filed Dec. 17, 2018, the entire disclosures of which are hereby incorporated by reference in their entirety.

FIELD OF INVENTION

This invention relates generally to beverage-ware in the form of beverage container sleeves and similar such beverage-ware devices for use with beverage containers. More particularly, the present invention relates to an ornamental and multi-functional beverage container accessory for engagement with water bottles, beer bottles, wine bottles, champagne bottles, liquor bottles, alcohol bottles, cups and similar beverage containers.

BACKGROUND

Vessels such as beverage containers are often used for the storing or displaying of liquid products. Accessory devices for beverage containers have been developed for adding to the utility and aesthetic design of various beverage containers. For example, accessories incorporating static designs have been developed to provide attractive designs and advertising space for an assortment of users including distributors, retailers and end users. Disclosed herein is an accessory device having the ability to incorporate and implement a variety of designs and operations to provide an assortment of beneficial uses for users. Some examples of such beneficial uses include the ability to program the accessory device to display chosen text, shapes or patterns and the ability to control the temperature of the accessory device such that the accessory device may heat or cool the beverage container, as desired by a given user. These and other features and advantages of the present invention will be explained and will become obvious to one skilled in the art through the summary of the invention that follows.

SUMMARY OF THE INVENTION

The present invention is an accessory for beverage containers such as bottles, cups and drinking glasses having the ability to engage with beverage containers of assorted shapes and sizes. The beverage container accessory of the present invention is designed for easy installment and removal from a beverage container. After installation, the accessory device may be removed or disengaged from the beverage container for position adjustment or to permit the cleaning of the beverage container.

The accessory device of the present invention relates specifically to an accessory device having a programmable visual display and an attachment mechanism enabling the device to couple the device to an assortment of beverage containers. In some embodiments, the accessory device includes a removable ornamental design such as a crown or similar ornamental structure, having a base configured to adjustably couple with beverage containers such as bottles, cups or drinking glasses.

BRIEF DESCRIPTION OF THE DRAWINGS

Embodiments of the present invention will now be described, by way of example only, with reference to the following diagrams wherein.

DETAILED DESCRIPTION

Figure 1A:
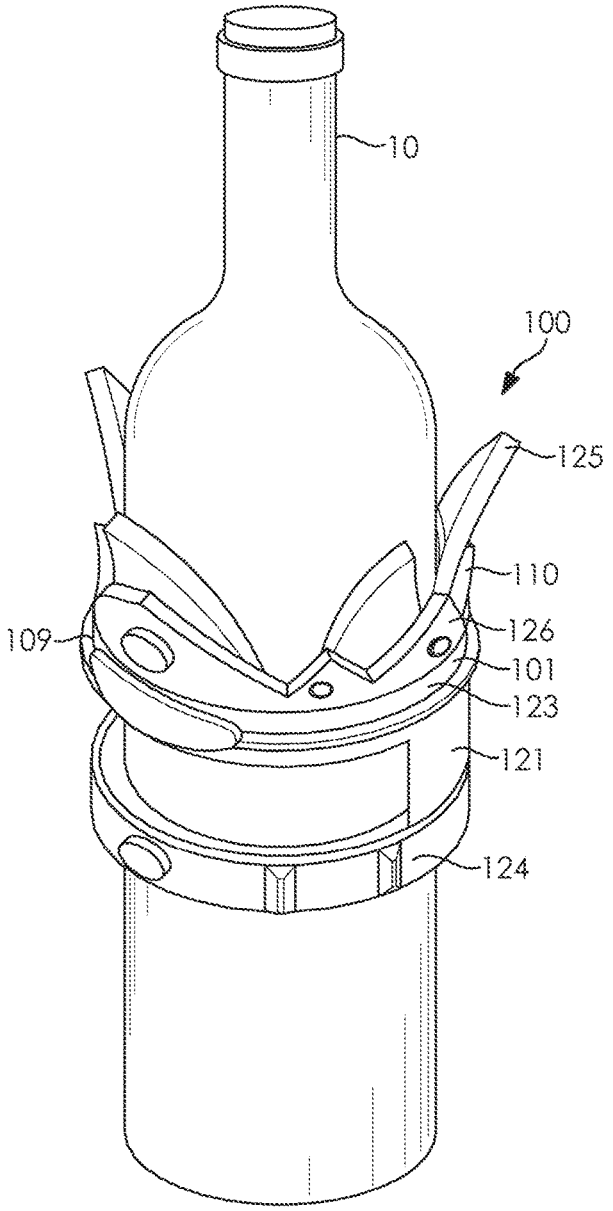
FIGS. 1A and 1B show a top perspective view of a programmable accessory for beverage containers engaged with a beverage container in accordance with an embodiment of the present invention.
Figure 1B:
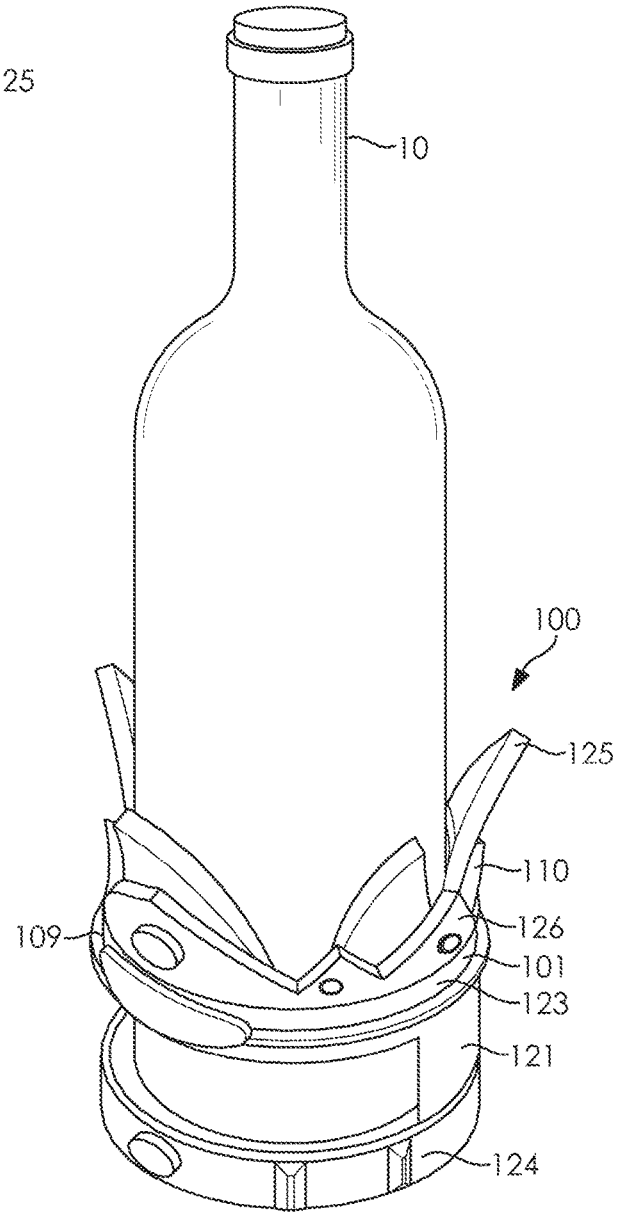
Figure 2:
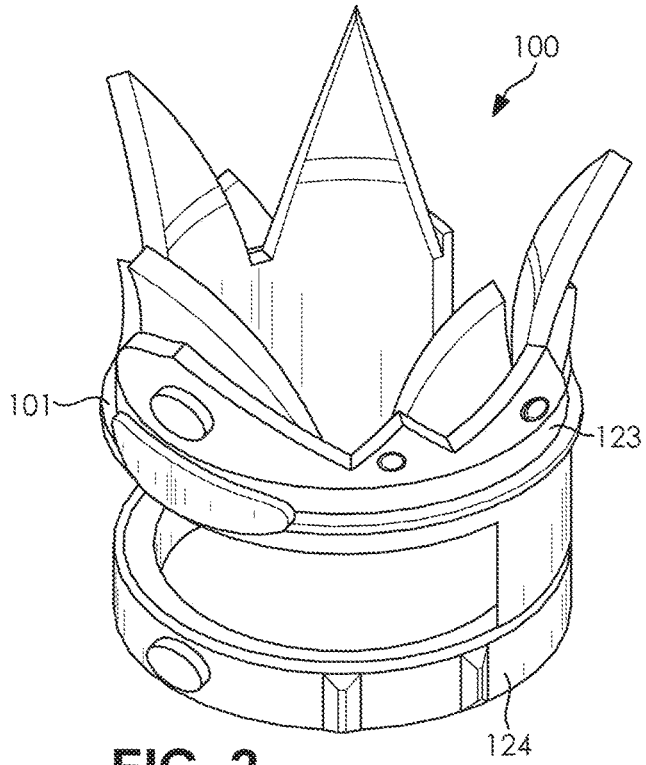
FIG. 2 shows a top perspective view of a programmable accessory for beverage containers in accordance with an embodiment of the present invention.

In the Summary above, the Detailed Description, the claims below, and in the accompanying drawings, reference is made to particular features (including method steps) of the present invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

Whenever a reference herein is made to a method comprising two or more defined steps, the defined steps can be carried out in any order or simultaneously (except where the context excludes that possibility), and the method can include one or more other steps which are carried out before any of the defined steps, between two of the defined steps, or after all of the defined steps (except where context excludes that possibility).

The present invention is directed to an apparatus and method for attaching and programming a beverage container accessory. The accessory device of the present invention is generally comprised of sensors, communication modules, and display assemblies. The sensors may be configured to receive and store operational data, the communication modules may transmit messages based on the data, including to the display assemblies, which are configured to display the transmitted data. For example, the accessory device may include a display unit with data sensors for gathering imaging data (e.g. text, image and pattern data) from a user, which may allow a user to use a controller device to control the display on the accessory device.

In an exemplary embodiment, the accessory device comprises a body, a programming means, a display assembly, a power source, and a beverage container engagement means. In some embodiments, the accessory device includes a temperature control means. In some embodiments, the accessory device includes a position monitoring means. In some embodiments, the invention may comprise additional or alternate components that will become understood by one of skill in the art as suitable for implementing the system taught herein, in each case without departing from the spirit or scope of the invention.

Referring now to FIGS. 1-4, an accessory device 100, in accordance with embodiments of the present invention, is shown. The accessory device 100, designed to engage with a beverage container 10, is comprised of a body 101 having a top edge 123, a bottom edge 124, a substantially circumferential wall 120 which connects the top edge 123 and the bottom edge 124, and a side surface 121. Surface 121 is generally constructed to engage with the outer surface of a beverage container 10. Accessory device 100 may be constructed of plastic or metal, and may be insulated to reduce radiation of heat through side surface 121. In some embodiments, the accessory device 100 may be configured to rest at and attach to the middle of the beverage container 10. In some embodiments, the accessory device may be configured to attach to the bottom of the beverage container 10 so as to function as a holder for the beverage container 10.

Figure 3:
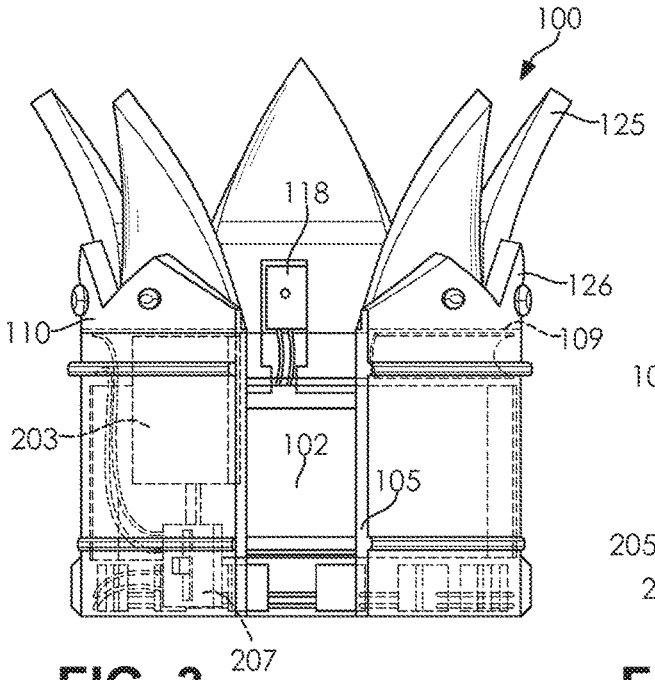
FIG. 3 shows a programmable accessory for beverage containers in accordance with an embodiment of the present invention.
Figure 4:
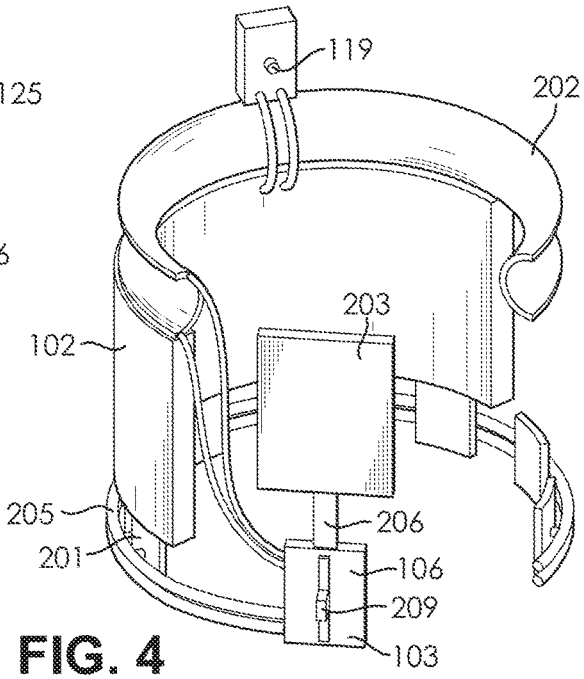
FIG. 4 shows a view of electrical components disposed within a programmable accessory for beverage containers in accordance with an embodiment of the present invention.

As shown in FIGS. 3 and 4, body 101 may encase the electrical components of display unit 102. For example, display unit 102, temperature control means 103, and power source 104 may be disposed within the body 101. In some embodiments, body 101 may be constructed to at least partially surround a portion of the outer surface of beverage container 10. In some embodiments, body 101 encases the electrical components of display unit 102. In some embodiments, a beverage container engagement means 105 may be disposed along an inner surface of body 101 to selectively engage accessory device 100 to the beverage container 10. In some embodiments, the engagement means 105 is comprised of rubber members. In some embodiments, the engagement means 105 is comprised of a manually operated latch mechanism. In some embodiments, the engagement means 105 is Velcro®. In some embodiments, the engagement means 105 is a hook and latch mechanism wherein a hook member is affixed to the beverage container 10 and a latch member is affixed to the accessory device 100 such that the accessory device 100 may selectively engaged with the beverage container 10.

In accordance with embodiments of the present invention, the body 101 of the accessory device 100 is generally designed to evenly distribute the weight of the accessory device around the circumference of a beverage container 10. In some embodiments, body 101 comprises an ornament attachment means 109 to selectively attach an ornament 110 to body 101. In some embodiments, ornament 110 is a crown-shaped ornament. In some embodiments, the crown shaped ornament includes a number of protrusions 125. In some embodiments protrusions 125 are curved. In some embodiments, the crown-shaped ornament has protrusion support members 126. In some embodiments, ornament 110 works to evenly distribute the weight of the accessory device around the circumference of the beverage container 10.

According to embodiments of the present invention, a light display, effectuated by a display unit 102, may be showcased and seen on or through the exterior side wall 122 of the body 100. In some embodiments, display unit 102 is an array of light-emitting diodes (LEDs) 111 that are individually logically addressable, such that the array is capable of displaying words, shapes, or patterns. Display unit 102 may comprise a circuit board 106, for example a printed circuit board (PCB), formed of a substrate such as polyimide film, having conductive paths and a plurality of LEDs 111 installed thereon. In some embodiments, the display unit 102 includes a control circuit unit for controlling the color, intensity and timing of LEDs 111. In a preferred embodiment, the LEDs are configured to be visible under a variety of lighting conditions, from dark conditions, such as a darkened or dimly lit indoor room or at night outdoors, to bright conditions, such as a brightly lighted indoor room or sunny daytime conditions.

While the circuit board 106 of the embodiment illustrated in FIGS. 3-4 is rectangular with straight sides, that need not be its shape in all embodiments. In some embodiments, the circuit board 106 may have any number of sides. For example, a pentagonal, hexagonal, or septagonal PCB could be made in some embodiments of the present invention.

Figure 5:
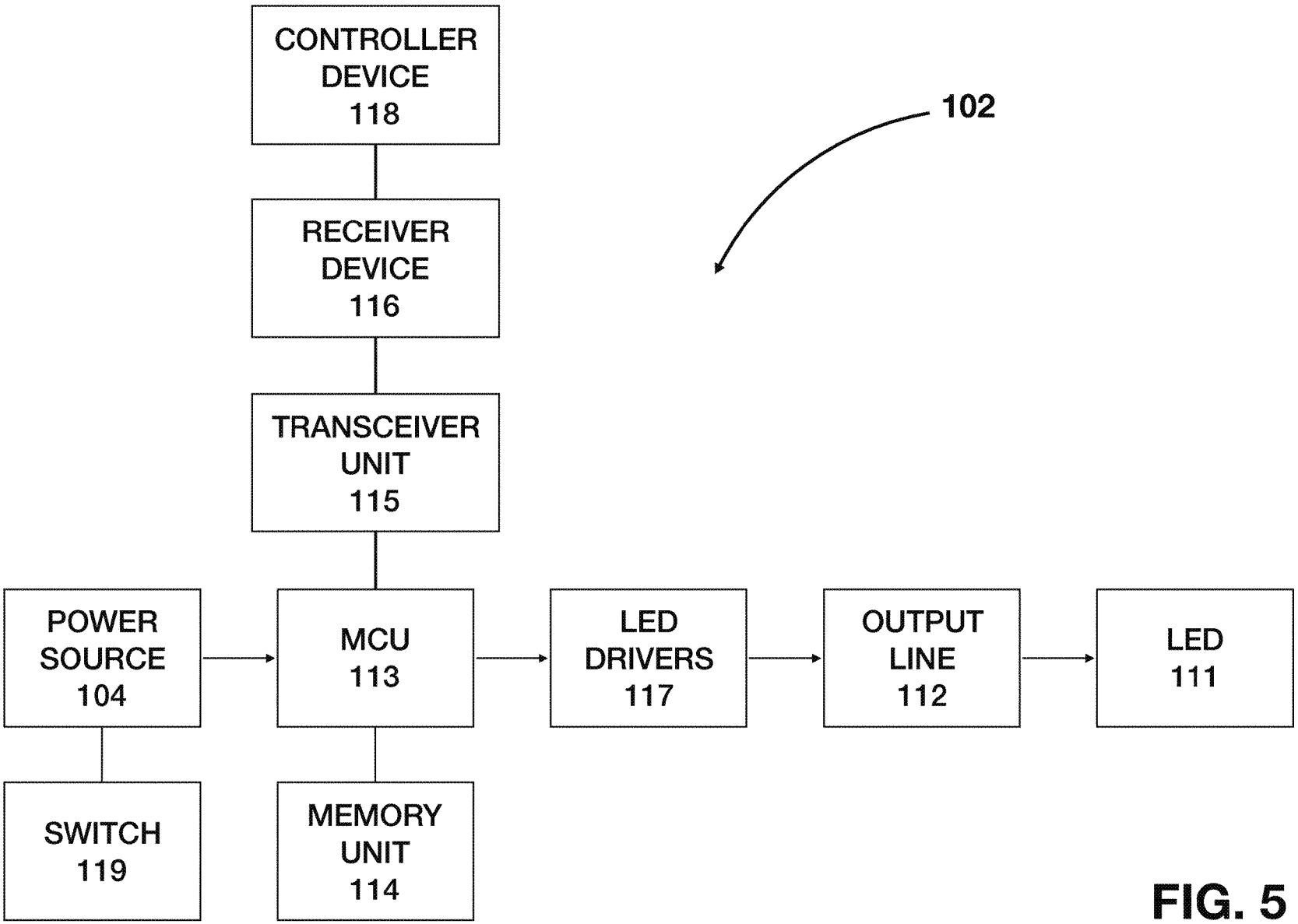
FIG. 5 shows a schematic diagram of the control electronics of a display unit for a programmable accessory for beverage containers in accordance with an embodiment of the present invention.

FIG. 5 is a schematic diagram of the control electronics for the display unit 102. In some embodiments, the function of display unit 102 is controlled by a microcontroller unit (MCU) 113, which draws power from a power source 104. The power source 104 may be a direct current (DC) power source. In some embodiments, the power source 104 may be batteries, such as rechargeable batteries. For example, the power source 104 can be lithium-ion (Li-ion) batteries or lithium polymer (Li-poly) batteries. However, in embodiments where the power source 104 are batteries, the batteries can be other suitable types (e.g., lead acid, nickel cadmium, nickel metal hydride). In some embodiments, the power source 104 may be a higher voltage alternating current (AC) source, coupled with a transformer, to bring the supplied power to acceptable DC voltage and current levels. In some embodiments, the power source 104 may be capacitors. The power source 104 may be directed to be turned on or off by a switch 119 or similar button capable of starting or stopping to supply power to the power source 104.

In some embodiments, the MCU 113 may be connected to a memory unit 114. In an exemplary embodiment, the memory unit 114 is a solid-state memory, such as Flash memory. Many similar types of memory may be used. The amount of memory in each display unit 102 will vary from embodiment to embodiment, depending on the capabilities of the display unit 102, the complexity of the images or patterns each is intended to show, and the number of LEDs 111 in the display unit 102, amongst other conventional factors.

In some embodiments, the MCU 113 may receive instructions from remote programming devices through a transceiver unit 115 that is coupled to a receiver device 116, such as an antenna, of an appropriate configuration. In some embodiments, the transceiver unit 115 is a Bluetooth® transceiver unit capable of receiving instructions and transmitting feedback. In some embodiments, other types of transceivers may provide different wireless and other communication capabilities. For example, WiFi® transceivers may be utilized to provide higher band-width or longer-range communication. Similarly, for example, conventional cellular transceivers for wireless data communications using a cellular network may equally be utilized. In some embodiments, multiple transceiver units 115 may be utilized for different communication modalities. In some embodiments, instead or in addition to transceiver unit 115, the display 102 may also include a Universal Serial Bus (USB) port, or similar physical connector, for data transfer. In some embodiments, display unit 102 may comprise a local programming device such as a physical memory unit having a number of pre-programmed, selectable words or patterns and a selector switch for the toggling between the selection of pre-programmed words or patterns.

According to embodiments of the present invention, the MCU 113 communicates with a plurality of LED drivers 117, each of which controls at least one LED 111. In some embodiments, LEDs 111 may be configured in a matrix orientation. LEDs 111 may be controlled by LED drivers 117 having a number of output lines 112. In some embodiments, transistors may regulate the power sent to the LEDs 111.

According to embodiments of the present invention, a controller 118 may direct the display unit 102. The controller 118 may define what word, picture, or pattern is to be displayed on display unit 102 and for how long such word, picture or pattern may be displayed on the display unit 102. In some embodiments, the controller 118 is external to the accessory device 100 and may communicate with the transceiver unit 115 through a wireless or physical communication protocol, such as Bluetooth®, WiFi®, USB and similar wireless or physical communication protocols. In some embodiments, the controller 118 is located on the device 100 and may communicate with the device 100 through electrical or wired communication protocols. In some embodiments, the controller 118 is a piece of hardware dedicated to the controlling of the display unit 102, or the accessory device 100 as a whole. In some embodiments, the controller 118 is an application or "app" that is implemented on a more general-purpose computing platform. For example, controller 118 may be an application to control display unit 102, implemented by a computer, tablet, or smartphone. More generally, the controller unit 118 may be any computing device having the ability to communicate with a display unit 102.

As noted above, the controller 118 may be a computing device having the ability to run software applications or apps that allow computing devices to perform the functions attributed to them. As the term is used here, "software" refers to sets of machine-readable instructions that are in a machine-readable form and that, when executed, cause the machine to perform the described tasks. The machine-readable medium may be any type of non-transitory memory, including magnetic disks, optical disks, solid-state drives, programmable read-only memory, external or internal FLASH drives, or any other known form of electronic storage medium.

Figure 6:
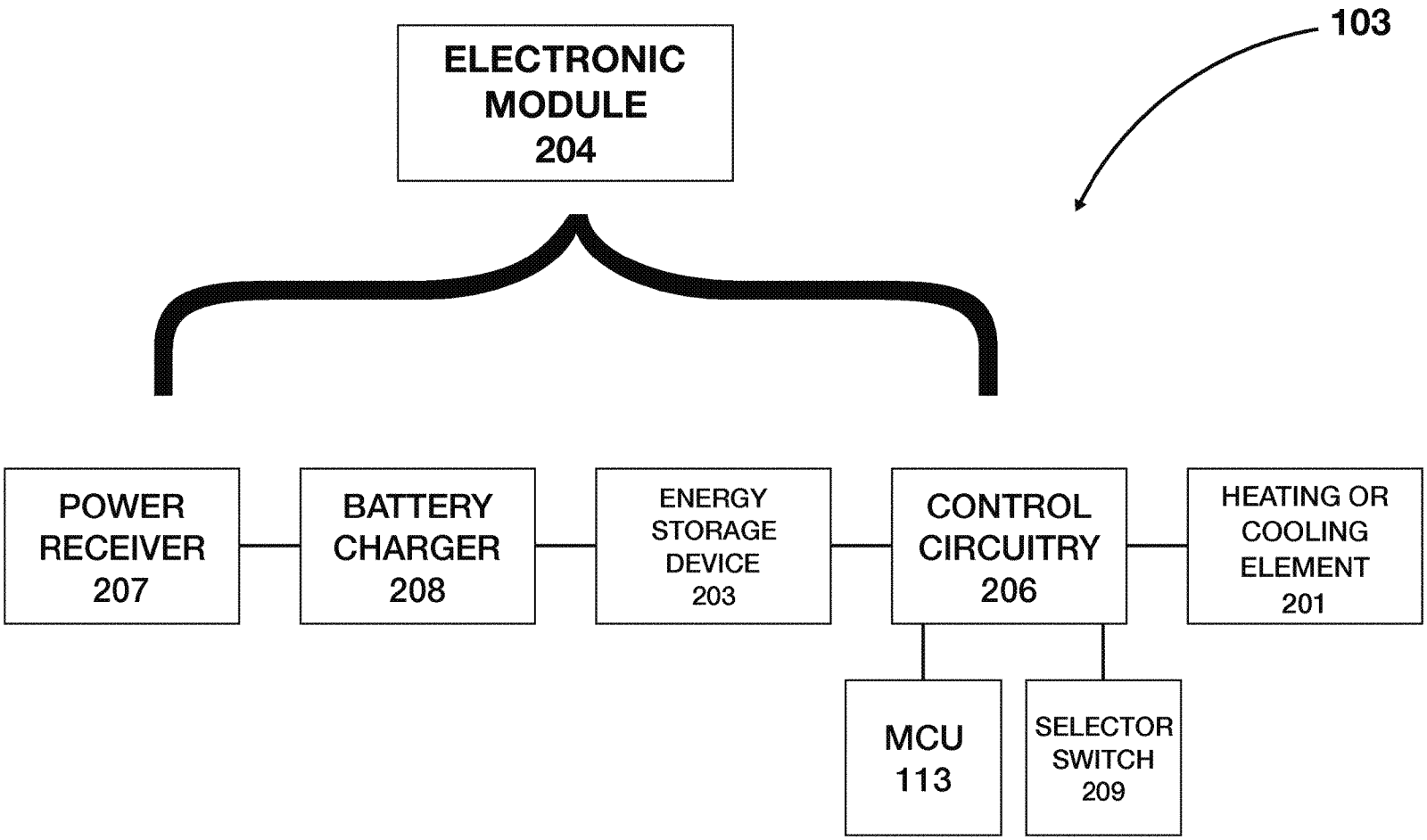
FIG. 6 shows a schematic diagram of the control electronics of a temperature control means for a programmable accessory for beverage containers in accordance with an embodiment of the present invention.

FIG. 6 is a schematic diagram of the electronics for a temperature control means 103. In some embodiments, temperature control means 103 is disposed within the body 101 of accessory device 100 for heating or cooling beverage container 10. In some embodiments, the temperature control means 103 may include a heating or cooling element 201, an insulative member 202, one or more electrical energy storage devices 203 electrically connected to at least one heating or cooling element 201, and an electronic module 204. In some embodiments, at least one heating or cooling element 201, insulative member 202, electrical energy storage device 203 and electronic module 204 may be disposed in an inner section of body 101. In some embodiments, the temperature control means 103 may be housed in a module that is removably attachable to the body 100.

In some embodiments, the temperature control means 103 includes a conductive liner 205. The conductive liner 205 may come in contact with heating or cooling element 201 to increase the heat exchange efficiency between the temperature control means 103 and the beverage container 10. In some embodiments, conductive liner 205 is composed of a heat-conductive material such as aluminum, stainless steel or another similar metal suitable for conducting heat from or to a substantial portion of the inner surface of accessory device 100.

In some embodiments, at least one heating or cooling element 201 may be a heater or heating wire that is disposed adjacent the side surface 121 of body 100, where the heater wire can heat up and transfer heat to the side surface 121 of the body 100 through conduction through the side surface 121 (e.g. to raise the temperature of the body 100 above ambient temperature to maintain liquids in beverage container 10 warm, such as at a desired temperature or within a desired temperature range).

In some embodiments, the insulative member 202 may be disposed proximate the heating or cooling element 201 so that the heating or cooling element 201 is interposed between the insulative member 202 and the side surface 121. In some embodiments, the insulative member 202 may be made of a thermally insulative material. In some embodiments, the insulative member 202 may be excluded.

According to embodiments of the present invention, the one or more electrical energy storage devices 203 is power source 104. In some embodiments, the one or more electrical energy storage devices 203 may be a direct current (DC) power source. In some embodiments, the one or more electrical energy storage devices 203 may be batteries, such as rechargeable batteries. For example, the one or more energy storage devices 203 can be lithium-ion (Li-ion) batteries or lithium polymer (Li-poly) batteries. In some embodiments, the one or more electrical energy storage devices 203 may be a higher voltage alternating current (AC) source, coupled with a transformer, to bring the supplied power to acceptable DC voltage and current levels. In some embodiments, the one or more electrical energy storage devices 203 may be capacitors. In some embodiments, the one or more energy storage devices 203 may be electrically connected to the heating or cooling element 201 and configured to supply power to the heating or cooling element 201 to heat or cool at least a portion of a beverage container 10. In some embodiments, the one or more energy storage devices 203 may be directed to be turned on or off by a switch or similar button capable of starting or stopping to supply power to the heating or cooling element 201.

The electronic module 204 may be electronically connected to the one or more electrical energy storage devices 203. In some embodiments, the electronic module 204 may include one or more of a control circuitry 206, a power receiver 207, and a battery charger 208 for charging or providing power to one or more energy storage devices 203. In some embodiments, the control circuitry 206 is a controller circuit, MCU, or any similar controller apparatus. In some embodiments, the electronic module 204 may include an MCU 113 with capacitive sensing and graphic control features. In some embodiments, the electronic module 204 may have different or additional electronics. In some embodiments, the electronic module 204 is configured to communicate with a communication device 302. The communication device 302 may send signals to the electronic module 204 to adjust the temperature setting of the accessory device 100. In some embodiments, a selector switch 209 is coupled to control circuitry 206 for the toggling between heating and cooling options.

In some embodiments, a power receiver 207 may be electronically connected to the battery charger 208, which is connected to the one or more energy storage devices 203 that are then electrically connected to the heating or cooling element 201 through a controller circuit 206. In some embodiments, the control circuitry 206 is used to manage the charging of the one or more energy storage devices 203. In some embodiments, control circuitry 206 can operate to manage the power delivered to the heating or cooling element 201.

Figure 7:
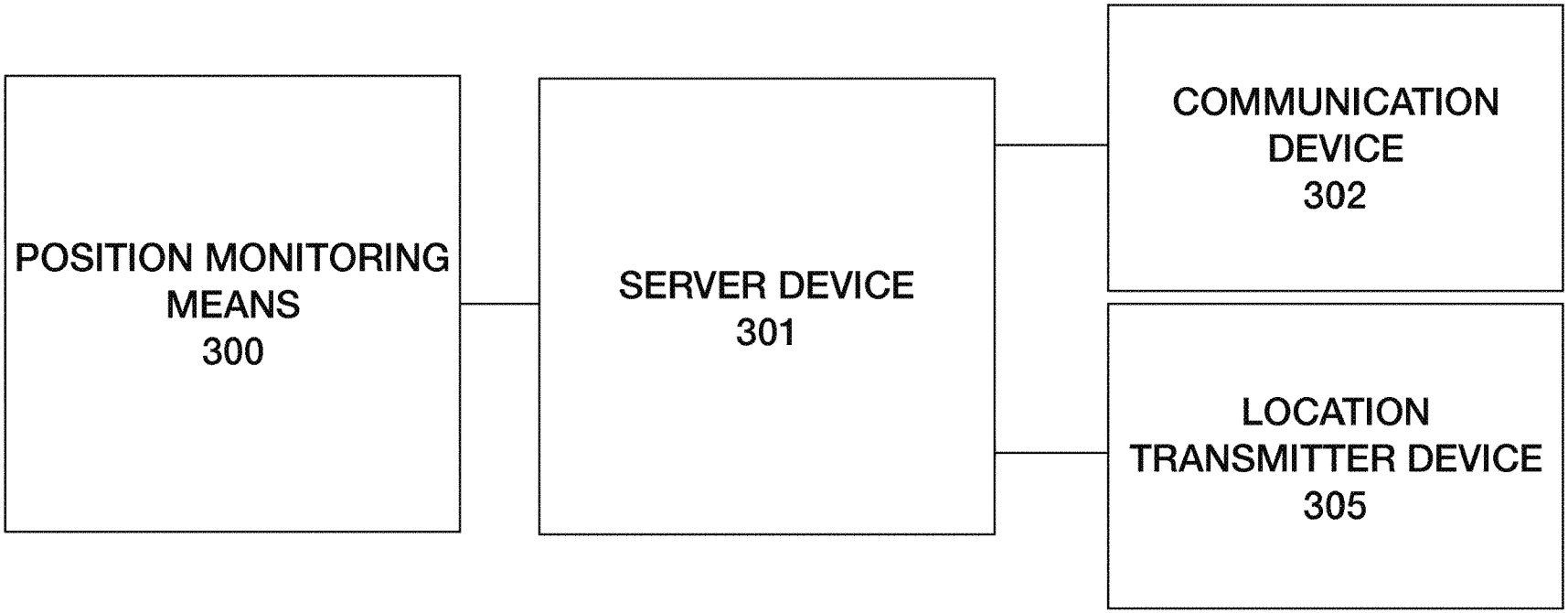
FIG. 7 shows a schematic diagram of the control electronics of a position monitoring means for a programmable accessory for beverage containers in accordance with an embodiment of the present invention.

As shown in FIG. 7, according to embodiments of the present invention, accessory device 100 may include a position monitoring means 300. Position monitoring means 300 may communicate with a server device 301 to enable server device 301 to perform accessory position monitoring. In an exemplary embodiment, server device 301 may be in communication with communication device 302, such as a controller 118, a smart phone, or computer. In some embodiments, server device 301 is also in communication with location transmitter devices 305. Location transmitter devices 305 may include a satellite and a cell phone tower.

In some embodiments, server device 301 receives location information directly from a position monitoring means 300. In this embodiment, location information may be received via one or more communication protocols, such as Bluetooth® or WiFi®. Additionally, position monitoring means 300 may also transmit information such as battery life for the accessory device 100. In some embodiments, server device 301 receives location information from satellite via communication protocols such as Global Positioning Systems (GPS). In some embodiments, server device 301 receives location information from cell phone tower, via communication protocols such as GSM or CDMA. In some embodiments, server device 301 receives location information from a controller 118 or communication device 302, enabled with Bluetooth®, such as a Bluetooth® beacon or similar Bluetooth® enabled transmitter, receiver, transponder, or transceiver. Location information may comprise, for example, the geographic coordinates of accessory device 100, representing the physical location of the accessory device 100, or some other location identifier.

In some embodiments, server device 301 is configured to receive location information via a variety of communication protocols and in a variety of formats. Server device 301 may be configured to communicate back to location transmitter devices 305, whether to acknowledge receipt of location information, perform communication health checks, transmit error messages, software updates, and the like. Server device 301 may be further configured to process received location information, store location information in a database, and transmit location information to communication device 302.

In some embodiments, communication device 302 may receive location information in the form of one or more location identifiers, distance values, address values, and the like. In some embodiments, communication device 302 processes location information and displays it on a screen in one or more formats. For example, communication device 302 may display a location of the accessory device 100 using a map view, wherein a contextual map of the current location of accessory device 100 is displayed, and periodically updates the display as the current location of the accessory device 100 changes.

In some embodiments, accessory device 100 communicates directly with server device 301 to send and receive location and tracking information. In some embodiments, accessory device 100 communicates with the satellite, cell phone tower, and communication device 302 directly.

In a preferred embodiment of the present invention, the accessory device comprises a body member shaped to selectively engage an exterior surface of a beverage container and a control unit coupled to the body member, the control unit including: a power source, a communication transceiver, one or more visual display driver coupled to the communication transceiver, and a visual display coupled to the visual display drivers.

In a preferred embodiment of the present invention, the accessory device comprises a body member shaped to selectively engage an exterior surface of a beverage container and a heating or cooling unit coupled to the body member, wherein the heating unit includes: an electronic module, a controller apparatus, at least one heating or cooling element, a conductive liner, and at least one electrical storage device.

In a preferred embodiment of the present invention, the accessory device comprises a body member shaped to selectively engage an exterior surface of a beverage container and a location monitoring means coupled to the body member, wherein the location monitoring means includes: a circuit board, a processor module, a location module coupled to the processor module, and a communication transceiver coupled to the processor module.

It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may have been omitted so as to not unnecessarily obscure the embodiments.

While multiple examples are disclosed, still other examples of the present invention will become apparent to those skilled in the art from this detailed description. The invention is capable of myriad modifications in various obvious aspects, all without departing from the spirit and scope of the present invention. Accordingly, the drawings and descriptions are to be regarded as illustrative in nature and not restrictive.

The invention claimed is:

1. A beverage container accessory device for releasable attachment to a beverage container comprising:

a body member that is a frame with an inner surface and an outer surface, wherein the inner surface defines a cavity that passes through the body member and is shaped to abut and selectively engage an exterior surface of the beverage container; and a control unit coupled to the body member, the control unit including:

a power source;

a communication transceiver;

at least one visual display driver coupled to said communication transceiver; and a visual display coupled to said at least one visual display driver.

2. The accessory device of claim 1, wherein said accessory device further comprises a memory unit to store program message content.

3. The accessory device of claim 1, wherein the frame has a first end and a second end that extend towards each other around the beverage container to define a gap between the first end and the second end of the frame.

4. The accessory device of claim 1, wherein said accessory device further comprises a position monitoring means.

5. The accessory device of claim 1, wherein said communication transceiver is configured to receive signals from local or remote devices.

6. The accessory device of claim 1, wherein said communication transceiver is programmed to accept signals defining words, images, and patterns.

7. The accessory device of claim 1, wherein said communication transceiver is programmed to transmit signals to said visual display drivers.

8. The accessory device of claim 1, wherein said visual display is controlled by a remote communication device.

9. The accessory device of claim 1, wherein said visual display is controlled by a local communication device.

10. The accessory device of claim 1, wherein the frame is continuous and is configured to wrap around the circumference of the beverage container.

11. The accessory device of claim 10, wherein a top side of the frame includes a panel disposed transverse to the cavity and is configured to rest on a top portion of a beverage bottle.

12. The accessory device of claim 1, wherein the location of the accessory device is monitored by a remote communication device.

13. The accessory device of claim 1, wherein said visual display is comprised of one or more LEDs.

14. The accessory device of claim 1, wherein said accessory device includes an ornament attachment means.

15. The accessory device of claim 1, wherein said accessory device is designed in the shape of a crown.

16. A beverage container accessory device for releasable attachment to a beverage container comprising:

a body member that is a frame with an inner surface, and an outer surface, and a visual display slot formed in the frame, wherein the inner surface defines a cavity that passes through the body member and is shaped to abut and selectively engage an exterior surface of the beverage container; and a control unit coupled to the body member, the control unit including:

a power source;

a communication transceiver;

at least one visual display driver coupled to said communication transceiver; and a visual display coupled to said at least one visual display driver and disposed in the visual display slot.

17. A beverage container accessory device for releasable attachment to a beverage container comprising:

a body member that is a frame with an inner surface, and an outer surface, and a visual display slot formed in the frame, wherein the inner surface defines a cavity that passes through the body member from a top side of the body member to a bottom side of the body member and is shaped to abut and selectively engage an exterior surface of the beverage container; and a control unit coupled to the body member, the control unit including:

a power source;

a communication transceiver;

at least one visual display driver coupled to said communication transceiver; and a visual display comprising one or more LEDs coupled to said at least one visual display driver and disposed in the visual display slot.

18. The accessory device of claim 17, wherein the frame has a first end and a second end that extend towards each other around the beverage container to define a gap between the first end and the second end of the frame.

* * * * *